United States Patent [19]

Kawai et al.

[11] Patent Number: 5,062,773

[45] Date of Patent: Nov. 5, 1991

[54] SWASH PLATE TYPE REFRIGERANT COMPRESSOR WITH A SEPARATOR OF REFRIGERANT GAS AND LUBRICANT OIL

[75] Inventors: Katsunori Kawai; Hayato Ikeda; Naoya Yokomachi; Toshihiro Kawai, all of Kariya, Japan

[73] Assignee: Kabushiki Kaisha Toyoda Jidoshokku Seisakusho, Aichi, Japan

[21] Appl. No.: 601,732

[22] PCT Filed: Mar. 2, 1990

[86] PCT No.: PCT/JP90/00274

§ 371 Date: Oct. 25, 1990

§ 102(e) Date: Oct. 25, 1990

[87] PCT Pub. No.: WO90/10156

PCT Pub. Date: Sep. 7, 1990

[30] Foreign Application Priority Data

Mar. 2, 1989 [JP] Japan ..... 1-50490

[51] Int. Cl.[5] ..... F04B 39/04; F04B 27/08; F01M 1/00

[52] U.S. Cl. ..... 417/269; 184/616

[58] Field of Search ..... 417/269, 270; 184/616

[56] References Cited

U.S. PATENT DOCUMENTS

| | | | |
|---|---|---|---|
| 2,689,080 | 9/1954 | Preiss | 184/16.6 |
| 4,070,136 | 1/1978 | Nakayama | 184/16.6 |
| 4,938,664 | 7/1990 | Zinsmeyer | 184/16.6 |

FOREIGN PATENT DOCUMENTS

| | | |
|---|---|---|
| 49-68902 | 7/1974 | Japan . |
| 51-642 | 1/1976 | Japan . |
| 56-23581 | 3/1981 | Japan . |
| 62-188565 | 12/1987 | Japan . |

*Primary Examiner*—Richard A. Bertsch
*Assistant Examiner*—Peter Korytnyk
*Attorney, Agent, or Firm*—Burgess, Ryan & Wayne

[57] ABSTRACT

The cylinder block assembly (1*a*) of a swash plate type refrigerant compressor is formed with a suction passageway (17) in which a refrigerant gas containing a mist-like lubricant oil therein is sucked and passed therethrough, and a cylindrical separating chamber (22) is formed by an extension (21) from an inner wall of the suction passageway and has an opening directed toward an entering direction of a flow of the lubricant oil-containing refrigerant gas. The separating chamber (22) is provided with an bottom wall (22*a*) having a through-hole for an entrance of the oil, communicating between the separating chamber (22) and a swash plate chamber (4). The refrigerant gas containing the lubricant oil therein enters the cylindrical separating chamber (22) arranged in the suction passageway (17) and impringes upon an inner wall (22*b*) and the bottom wall (22*a*), whereby the flow direction thereof is changed, and flows out of the chamber through the opening into the suction passageway to thereby separate the lubricant oil from the refrigerant gas. The separated lubricant oil is supplied from the separating chamber (22) into the swash plate chamber (4), without overflowing from the chamber toward the suction passageway.

4 Claims, 4 Drawing Sheets

SWASH PLATE TYPE REFRIGERANT COMPRESSOR WITH A SEPARATOR OF REFRIGERANT GAS AND LUBRICANT OIL

TECHNICAL FIELD

The present invention relates to a swash plate type refrigerant compressor, and more particularly to a swash plate type refrigerant compressor provided with a cylinder block having a suction passageway formed therein which permits a refrigerant gas containing a mist-like lubricant oil to enter the passageway per se, and permits the mist-like lubricant oil to be separated from the refrigerant gas, whereby the separated oil flows into a swash plate chamber and the oil removed refrigerant gas is sucked and compressed in cylinder bores of the cylinder block.

BACKGROUND ART

Generally, an automobile air-conditioner accommodating a refrigerant compressor uses a refrigerant gas containing therein a mist-like lubricant oil, i.e., oil fine particles. The lubricant oil is needed for lubricating the compressor. Nevertheless, when the lubricant oil is adhered to an evaporator arranged in the refrigerating circuit of the air-conditioner, the evaporator is unable to conduct an effective thermal exchange, and accordingly, the refrigerating efficiency of the air-conditioner is lowered. Further, when an increase in the amount of the lubricant oil contained in the refrigerant gas flowing in the refrigerating circuit occurs, the amount of the lubricant oil remaining inside the compressor is accordingly reduced, and therefore, the internal movable elements of the compressor suffer from a lack of lubrication. Accordingly, the adoption of a method of separating the mist-like lubricant oil from the refrigerant gas is required when the oil-containing refrigerant gas enters the compressor to be compressed therein.

One typical conventional swash plate type refrigerant compressor is provided with an internal construction such that a small hole is formed in a cylinder block of the compressor, to allow a communication between a suction passageway and a swash plate chamber and thereby permit a flow of the refrigerant gas from the swash plate chamber when a pressure of the refrigerant gas in the swash plate chamber becomes excessively high due to a bleeding of a blow-by refrigerant gas from cylinder bores into the swash plate chamber. In this compressor, a small amount of lubricant oil separated from the refrigerant gas, due to an impingement of the oil-containing refrigerant gas upon the internal wall of the suction passageway when entering the compressor from an external refrigerating circuit, is allowed to enter the swash plate chamber through the above-mentioned small hole. Nevertheless, such a small hole is unable to positively separate the lubricant oil from the lubricant oil-containing refrigerant gas, to thereby draw the lubricant oil into the swash plate chamber. This is because the small hole has different action from that of a baffle plate, and cannot function to deaden the flow inertia of the lubricant oil-containing refrigerant gas when it enters the compressor from the outside. Namely, the small hole of the typical conventional swash plate type compressor cannot function to separate the oil component from the refrigerant gas.

DISCLOSURE OF THE INVENTION

Accordingly, an object of the present invention is to obviate the above-mentioned defects encountered by the conventional swash plate type refrigerant compressor.

Another object of the present invention is to provide a swash plate type refrigerant compressor having a separating means for separating the oil component from the mist-like lubricant oil-containing refrigerant gas, whereby a positive separation of the oil component in a suction passageway of the compressor and supply of the separated lubricant oil to a swash plate chamber of the compressor are carried out.

In accordance with the present invention, there is provided a swash plate type refrigerant compressor with a unit for separating lubricant oil from a refrigerant gas, which comprises:

a cylinder block provided with a suction passageway formed therein to permit passing of a mist-like oil-containing refrigerant gas therethrough when such a refrigerant gas enters the cylinder block from an external refrigerating circuit;

a cylindrical separating chamber provided in an inner wall of the suction passageway of the cylinder block, the chamber having an opening which opens against the flow of the mist-like oil-containing refrigerant gas, and an internal bottom wall having a through-hole fluidly communicating the cylindrical separating chamber and a swash plate chamber of the compressor, to thereby permit separated lubricant oil to flow into the swash plate chamber.

The mist-like oil-containing refrigerant gas is drawn toward the suction passageway, and initially enters the cylindrical separating chamber via the opening thereof. Inside the cylindrical separating chamber, the mist-like oil-containing refrigerant gas impinges on the inner wall and bottom wall of the chamber while changing a flow direction thereof, and the gas comes out of the separating chamber and flows through the suction passageway. Accordingly, the inner wall and bottom wall of the cylindrical separating chamber are able to function as a baffle means against the flow of the mist-like oil-containing refrigerant gas, and therefore, an effective separation of the oil from the refrigerant gas is achieved. The separated lubricant oil held in the cylindrical separating chamber is supplied into the swash plate chamber via the communicating through-hole, and does not flow toward the suction passageway.

DESCRIPTION OF THE DRAWINGS

The above and other objects, features, and advantages of the present invention will be made more apparent from the ensuing description of the embodiments with reference to the accompanying drawings wherein.

BEST MODE OF CARRYING OUT THE INVENTION

Figure 1:
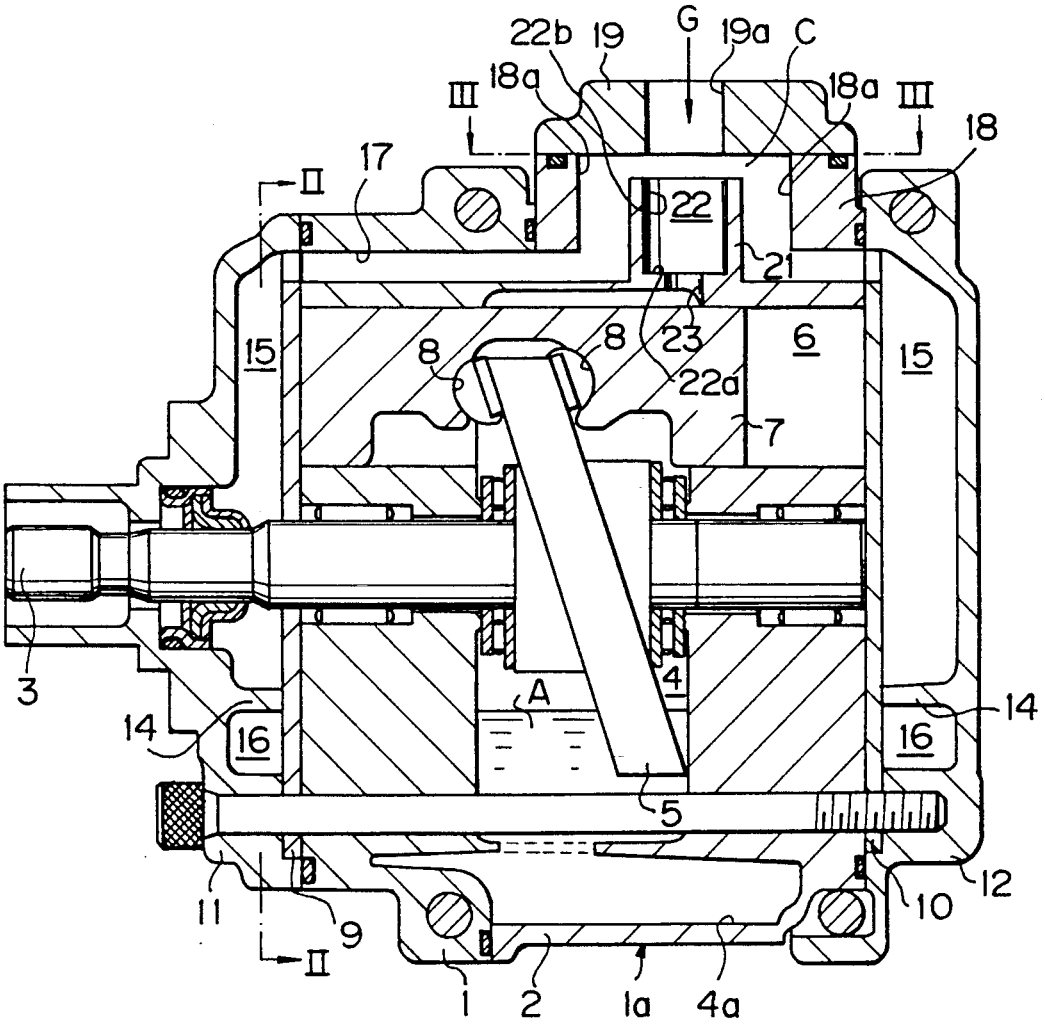
FIG. 1 is a cross-sectional view, taken along line I—I of FIG. 2, of a swash plate type refrigerant compressor provided with a separating unit for separating lubricant oil from a refrigerant gas according to a first embodiment of the present invention.
Figure 2:
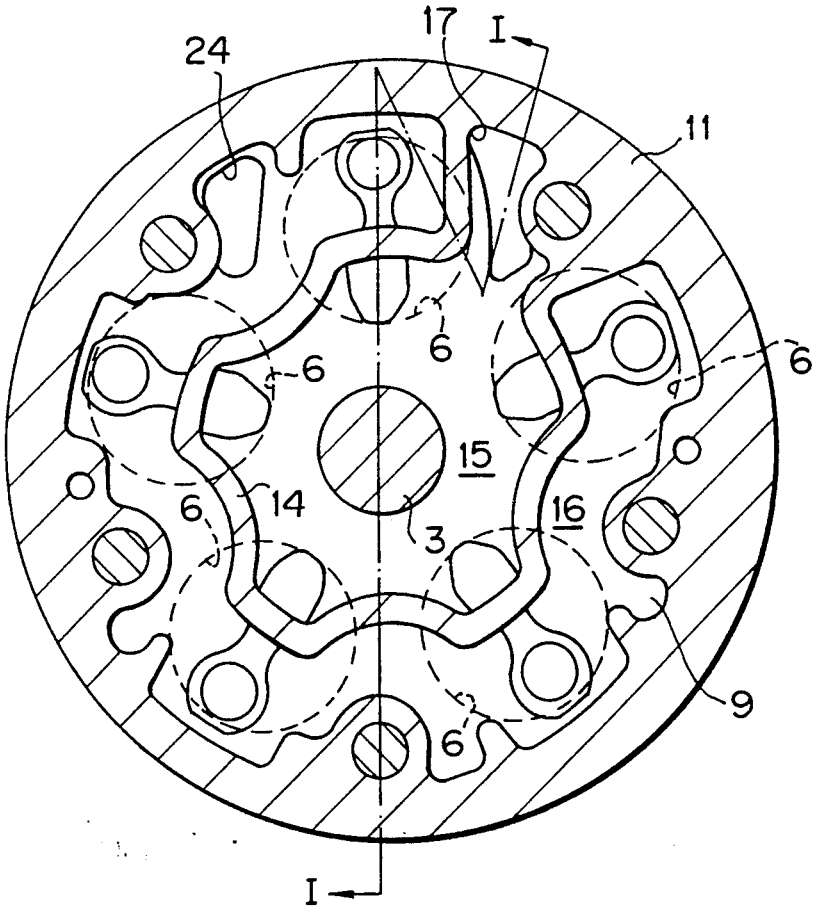
FIG. 2 is a cross-sectional view taken along the line II—II of FIG. 1.

Referring to FIG. 1, a swash plate type refrigerant compressor according to a first embodiment of the present invention is provided with a cylinder block assembly 1*a* including front and rear cylinder blocks 1 and 2. The cylinder block assembly 1 is provided with a swash plate chamber 4 formed therein, and an oil pan 4*a* formed underneath the swash plate chamber 4. A drive shaft 3 connectable to a rotation drive source is rotatably supported by the front and rear cylinder blocks 1 and 2, and a swash plate 5 arranged in the swash plate chamber 4 is firmly mounted on the drive shaft 3 to be rotatable with the drive shaft 3. The cylinder block assembly 1*a* is provided with a plurality of axial cylinder bores 6 ( five cylinder bores in the present embodiment as shown in FIG. 2 ) arranged around the drive shaft 3, and a double-headed piston 7 is reciprocatorily received in each of the cylinder bores 6. The double-headed pistons 7 are engaged with the swash plate 5 via shoes 8. When the swash plate 5 is rotated to wobble around the axis of rotation of the drive shaft 3, the pistons 7 are reciprocated to perform a suction, compression, and discharge of a refrigerant gas. The ends of the front and rear cylinder blocks 1 and 2 are closed by front and rear housings 11 and 12, in such a manner that these housings are sealingly fixed to the front and rear cylinder blocks 1 and 2 by screw bolts via front and rear valve plates 9 and 10.

As illustrated in FIGS. 1 and 2, inner walls 14 are formed in the front and rear housings 11 and 12, to define suction chambers 15 for the refrigerant gas before compression and discharge chambers 16 for the refrigerant after compression.

A suction passageway 17 is arranged above the cylinder block assembly 1*a* including the front and rear cylinder blocks 1 and 2, and axially extended and fluidly connected to the suction chambers 15 of the front and rear housings 11 and 12. A bulged portion 18 is integrally formed on the upper surface of the rear cylinder block 2 and radially extended from the rear cylinder block 2 with respect to the axis of the cylinder block assembly 1*a*. The bulged portion 18 is provided therein with a pair of radial suction ports 18*a*, which form a portion of the axial suction passageway 17. One dot line "$C_L$" of FIG. 3 indicates an axis of the drive shaft 3. A suction flange 19 is attached to the top of the bulged portion 18, and is provided with an inlet port 19*a* formed therein for permitting a refrigerant gas returned from the external circuit to enter the compressor.

Figure 3:
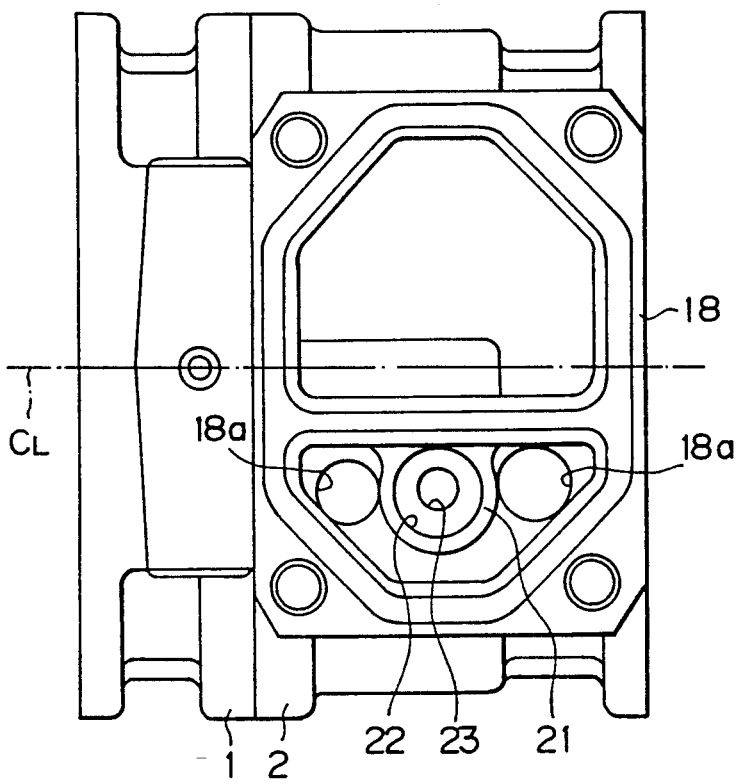
FIG. 3 is a cross-sectional view taken along the line III—III of FIG. 1.

As illustrated in FIGS. 1 and 3, a cylindrical raised portion 21 is formed at a lower bottom wall of the suction passageway 17 and arranged between the abovementioned suction ports 18*a*. The cylindrical raised portion 21 has an upper opening directed to be opposite to a direction of a flow G of the refrigerant gas. A spacing "C" is formed between the outer circumference of the cylindrical raised portion 21 and the inner wall of the suction passageway 17. The cylindrical raised portion 21 has a separating chamber 22 in the form of a cylindrical inner chamber having a bottom wall 22*a* in which a through-hole 23 is formed to provide a fluid communication between the abovementioned swash plate chamber 4 and the separating chamber 22.

As illustrated in FIG. 2, the front and rear cylinder blocks 1 and 2 are provided with an axial discharge passageway 24 formed therein and communicated with the discharge chambers 16 at the front and rear sides of the cylinder block assembly 1*a*. Therefore, the refrigerant gas after compression is discharged from the front and rear discharge chambers 16 toward the external refrigerating circuit through the discharge passageway 24.

The operation and advantages of the embodiment having the above-mentioned constitution and arrangement will be described below.

When the drive shaft 3 is rotated together with the swash plate 5, to thereby commence a compressing operation by the double-headed pistons 7, a refrigerant gas G from the refrigerating circuit enters the suction chambers 15 via the suction passageway 17, and subsequently, enters the cylinder bores 6 from the suction chambers 15 to be compressed therein. After compression, the refrigerant gas under a high pressure is discharged toward the discharge chambers 16, and further discharged toward the external refrigerating circuit via the discharge passageway 24.

When the refrigerant gas G is pumped in the suction passageway 17 from the suction port 19*a*, the gas initially enters the separating chamber 22 from the upper opening thereof. The refrigerant gas G impinges upon the circumferential wall 22*b* and the bottom wall 22*a* of the separating chamber 22, and accordingly, a mist-like lubricant oil contained in the refrigerant gas is separated from the refrigerant gas component. Therefore, the refrigerant gas G containing only a least amount of lubricant oil, due to the separation, flows out of the separating chamber 22 via the upper opening and the spacing C toward the suction passageway 17.

Figure 4:
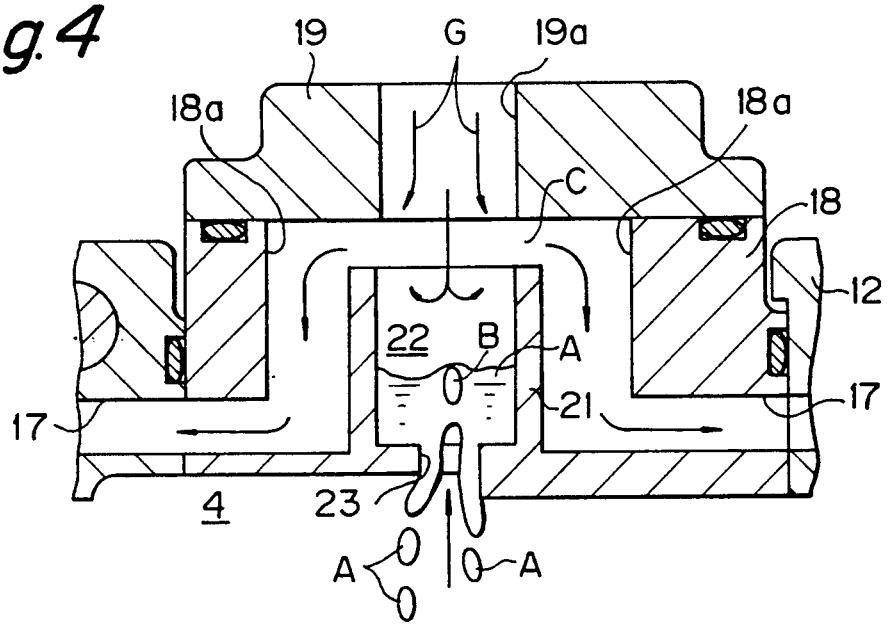
FIG. 4 is an enlarged view of important portions, such as a separating chamber and a suction chamber, of FIG. 1.

The separated lubricant oil A is held in the separating chamber 22 and does not flow directly out of there but gradually flows into the swash plate chamber 4 through the communicating through-hole 23 of the bottom wall 22*a* of the separating chamber 22. Note: as illustrated in FIG. 4, when a substantive amount of the lubricant oil is reserved in the separating chamber 22, and when a part of the refrigerant gas G under pressure flows from the swash plate chamber 4 via the through-hole 23, the gas becomes bubbles B and passes through the lubricant oil A reserved in the separating chamber 22. Therefore, an oil component contained in the refrigerant gas is caught by the lubricant oil per se reserved in the separating chamber 22, and accordingly, only the refrigerant gas eventually flows toward the suction chamber 17.

Therefore, in the swash plate type compressor provided with separating unit for separating the lubricant oil from the refrigerant gas in accordance with the present invention, the circumferential wall 22*b* and the bottom wall 22*a* of the separating chamber 22 act as a baffle means against the flow of the lubricant oil contained refrigerant gas, and therefore, it is possible to effectively separate the mist-like oil from the oil-containing refrigerant gas. Further, the separated oil A is reserved, and supplied to the swash plate chamber 4 to lubricate the movable elements of the compressor, and accordingly, the problems such as a lack of lubrication of the movable elements of the compressor, and the lowering of the refrigerating efficiency encountered by the conventional compressor can be solved.

Figure 5:
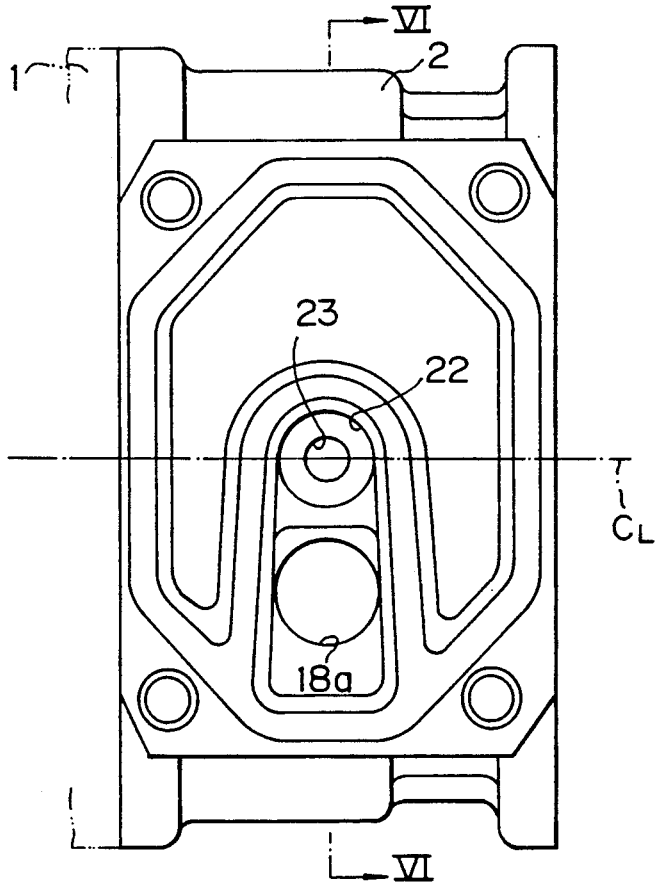
FIG. 5 is a plan view of the cylinder block of a swash plate type refrigerant compressor provided with a separating unit for separating lubricant oil from a refrigerant gas according to a second embodiment of the present invention.
Figure 6:
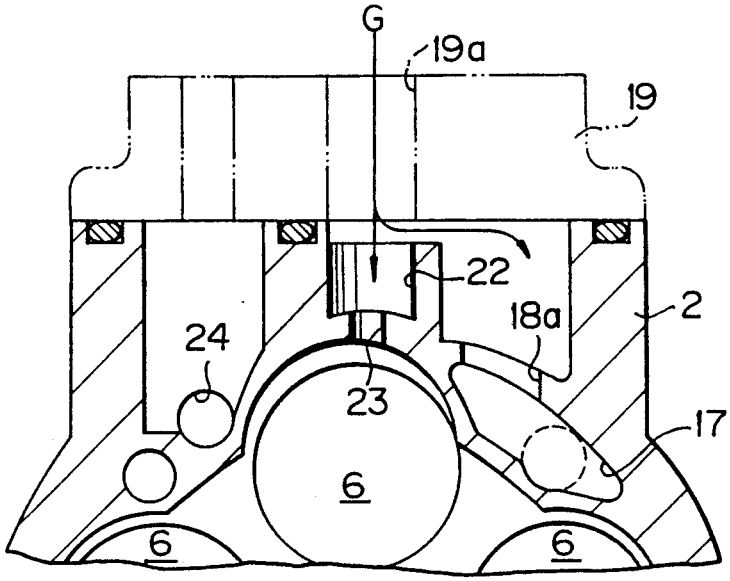
FIG. 6 is a cross-sectional view taken along the line VI—VI of FIG. 5.

The second embodiment of the present invention will be described below with reference to FIGS. 5 and 6.

In the second embodiment, as will be obvious from the comparison thereof with the previous embodiment of FIG. 3, the separating chamber 22 and the communicating through-hole 23 are arranged at a position located directly above the drive shaft 3. Namely, the centers of the separating chamber 22 and the communicating through-hole 23 substantially coincide with the center of the drive shaft 3.

Therefore, in accordance with this second embodiment, the separation of the lubricant oil from the refrigerant gas, as well as a lubrication and cooling by the lubricant oil, are achieved as in the first embodiment. Moreover, a sufficient lubrication of the drive shaft 3 and the elements and parts for supporting the shaft can be achieved due to the abovementioned arrangement of the separating chamber and the communicating through-hole directly above the drive shaft.

The present invention is not limited to the embodiments described above; for example, the shape of the separating chamber 22 and the communicating through-hole 23 may be varied from the illustrated cylindrical shape. Further, the present invention may be applied to either a swash plate type compressor of the type wherein an oil pump is used for forcibly lubricating the elements of the compressor or a wobble plate type compressor, without departing from the spirit and scope thereof. Particularly, in the case of a compressor employing an oil pump, a large amount of lubricating oil is supplied by the oil pump to the slidable moving parts of the compressor, and therefore, a large amount of lubricant oil enters the swash plate chamber. Accordingly, a large amount of mist-like oil is necessarily contained in the refrigerant gas, and thus the lubricant oil separating means of the present invention is particularly effective in such a compressor having an oil pump.

From the foregoing, it will be understood that, in accordance with the present invention, the mist-like lubricant oil contained in the refrigerant gas can be separated from the gas in the separating chamber, and the separated lubricant oil supplied through a through-hole into the swash plate chamber, and therefore, a lack of lubrication of the internal elements of the compressor can be prevented. Further, a lowering of the refrigerating efficiency due to an adhering of the lubricant oil to the evaporator can be prevented.

I claim:

1. A swash plate type refrigerant compressor provided with a separating means for conducting a separation of lubricant oil from a refrigerant gas, comprising:

a cylinder block assembly provided with a plurality of cylinder bores arranged around a fixed axis, and a swash plate chamber;

a drive shaft rotatably supported by said cylinder block assembly, and having an axis of rotation coinciding with said fixed axis;

a swash plate mounted on said drive shaft to be rotated therewith, and wobbled in said swash plate chamber;

a plurality of double-headed pistons arranged to be reciprocated in said cylinder bores of said cylinder block assembly in response to a rotation of said drive shaft and said swash plate, to thereby perform a suction, compression, and discharge of the refrigerant gas;

suction passageway means provided in said cylinder block assembly for permitting a refrigerant gas in which a lubricant oil is suspended and contained to flow toward said cylinder bores when sucked from an external refrigerating circuit;

cylindrical chamber means for a separation of the lubricant oil from the refrigerant gas, arranged in a part of said suction passageway means, and provided with an opening directed toward an entering direction of a flow of said refrigerant gas from said external refrigerating circuit into said cylinder block assembly, and having an internal spacing having an appreciable volume defined therein; and a communicating through-hole formed in a bottom wall of said cylindrical chamber means for fluidly communicating between said internal spacing of said chamber means and said swash plate chamber, to thereby permit said lubricant oil to flow from said cylindrical chamber means into said swash plate chamber.

2. A swash plate type refrigerant compressor provided with separating means for conducting a separation of lubricant oil from a refrigerant gas according to claim 1, wherein said cylindrical chamber means comprise a cylindrical recess enclosed and defined by a cylindrical wall extended from an inner wall of said suction passageway means, said cylindrical recess being provided with a bottom wall thereof having said communicating through-hole formed therein.

3. A swash plate type refrigerant compressor provided with separating means for conducting a separation of lubricant oil from a refrigerant gas according to claim 2, wherein said cylindrical recess enclosed and defined by said cylindrical wall of said cylindrical chamber means is communicated with said suction passageway means via a space.

4. A swash plate type refrigerant compressor provided with separating means for conducting a separation of lubricant oil from a refrigerant gas according to claim 1, wherein said opening of said cylindrical chamber means and said communicating through-hole are arranged directly above said axis of rotation of said drive shaft.

* * * * *